US010625522B2

(12) United States Patent
Nakamura et al.

(10) Patent No.: US 10,625,522 B2
(45) Date of Patent: Apr. 21, 2020

(54) IMAGE ADDING SYSTEM, PRINTER, CLOTH HOLDER, AND HOLDER WITH CLOTH

(71) Applicants: Daisuke Nakamura, Kanagawa (JP); Kazuyoshi Matsumoto, Tokyo (JP); Kenji Hiratani, Kanagawa (JP); Yoshinori Uchino, Kanagawa (JP); Tsuyoshi Miyata, Kanagawa (JP); Kohei Chubachi, Tokyo (JP)

(72) Inventors: Daisuke Nakamura, Kanagawa (JP); Kazuyoshi Matsumoto, Tokyo (JP); Kenji Hiratani, Kanagawa (JP); Yoshinori Uchino, Kanagawa (JP); Tsuyoshi Miyata, Kanagawa (JP); Kohei Chubachi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/584,461

(22) Filed: May 2, 2017

(65) Prior Publication Data

US 2017/0320316 A1 Nov. 9, 2017

(30) Foreign Application Priority Data

May 6, 2016 (JP) ..... 2016-093194
Mar. 15, 2017 (JP) ..... 2017-050101

(51) Int. Cl.
*B41J 3/407* (2006.01)
*B41J 11/06* (2006.01)

(52) U.S. Cl.
CPC ..... *B41J 11/06* (2013.01); *B41J 3/4078* (2013.01)

(58) Field of Classification Search
CPC ... B41F 16/006; B41F 16/008; B41M 5/0358; B41M 5/035; B32B 33/00; D06P 5/2072; D06P 5/003; D06P 5/004; D06P 5/30; B41J 13/0054; B41J 13/103; B41J 13/12; B41J 13/18; B41J 13/226; B41J 13/24; B41J 17/02
See application file for complete search history.

(56) References Cited

U.S. PATENT DOCUMENTS

2003/0197772 A1* 10/2003 Iwatsuki ..... B41J 3/4078 347/104
2005/0179708 A1* 8/2005 Ben-Zur ..... B41J 3/28 347/2
2010/0026772 A1 2/2010 Miyata
2012/0206552 A1 8/2012 Uchino
(Continued)

FOREIGN PATENT DOCUMENTS

JP 2003-311938 11/2003
JP 2003-312069 11/2003
(Continued)

*Primary Examiner* — Kristal Feggins
(74) *Attorney, Agent, or Firm* — Oblon, McClelland, Maier & Neustadt, L.L.P.

(57) ABSTRACT

An image adding system includes a cloth holder to hold a cloth to which an image is added, a printer to print the cloth held by the cloth holder with an image, and a heater to heat the cloth. The cloth holder is used by both the printer and the heater with the cloth held on the cloth holder when the printer prints the image on the cloth and the heater heats the cloth.

20 Claims, 12 Drawing Sheets

(56) References Cited

U.S. PATENT DOCUMENTS

| | | | | |
|---|---|---|---|---|
| 2014/0020189 | A1* | 1/2014 | Weibel | D06B 1/02 8/499 |
| 2014/0099149 | A1 | 4/2014 | Kikura et al. | |
| 2014/0099150 | A1 | 4/2014 | Matsumoto et al. | |
| 2015/0054898 | A1 | 2/2015 | Kondo et al. | |
| 2015/0091971 | A1 | 4/2015 | Matsumoto et al. | |
| 2016/0109038 | A1 | 4/2016 | Matsumoto et al. | |
| 2017/0119072 | A1* | 5/2017 | Coulombe | A41D 27/08 |

FOREIGN PATENT DOCUMENTS

| | | |
|---|---|---|
| JP | 2004-268506 | 9/2004 |
| JP | 2013-226657 | 11/2013 |
| JP | 2013-244615 | 12/2013 |
| JP | 2014-162171 | 9/2014 |
| JP | 2015-218418 | 12/2015 |

* cited by examiner

IMAGE ADDING SYSTEM, PRINTER, CLOTH HOLDER, AND HOLDER WITH CLOTH

CROSS-REFERENCE TO RELATED APPLICATIONS

This patent application is based on and claims priority pursuant to 35 U.S.C. § 119(a) to Japanese Patent Application Nos. 2016-093194, filed on May 6, 2016, and 2017-050101, filed on Mar. 15, 2017, in the Japan Patent Office, the entire disclosures of which are hereby incorporated by reference herein.

BACKGROUND

Technical Field

Embodiments of the present disclosure relate to an image adding system, a printer, a cloth holder, and a holder with a cloth.

Related Art

In the past, a known printing apparatus includes a medium supporting unit disposed in a non-heat area to support a medium conveyed to the medium supporting unit thereon, a head disposed in the same area to eject liquid onto the medium, and a drying unit disposed in a heat area to dry the liquid landing on the medium.

Further, in a known image adding apparatus such as a textile printing device, etc., that prints an image on cloth (including a processed product such as a T-shirt, etc.), when the image is printed by applying liquid to the cloth, for example, by using a liquid discharge head, it is necessary not only to dry the cloth bearing the image thereon, but also to heat and fix the image into the cloth at a high temperature for a certain period of time.

SUMMARY

One aspect of the present disclosure provides a novel image adding system that includes a cloth holder to hold a cloth to which an image is added, a printer to print the cloth held by the cloth holder with an image, and a heater to heat the cloth. The cloth holder is used by both the printer and the heater with the cloth held on the cloth holder when the printer prints the image on the cloth and the heater heats the cloth.

Another aspect of the present disclosure provides a novel printer used in an image adding system that includes a heater to heat a cloth. The printer includes a cloth holder to hold a cloth to which an image is added, a holder receiver detachably holding the cloth holder, and a printing unit to print an image on the cloth. The cloth holder is attachable to the heater with the cloth held on the cloth holder after the cloth holder is removed from the holder receiver of the printer.

Yet another aspect of the present disclosure provides a novel cloth holder that holds a cloth. The cloth holder is used by both a printing device to print the cloth with an image and a heater to heat the cloth bearing the image.

Yet another aspect of the present disclosure provides a novel holder with a blank cloth. The holder includes the above-described cloth holder and a blank cloth held by the cloth holder. At least a portion of the blank cloth is held flat by the cloth holder.

BRIEF DESCRIPTION OF THE DRAWINGS

A more complete appreciation of the present disclosure and many of the attendant advantages of the present disclosure will be more readily obtained as substantially the same becomes better understood by reference to the following detailed description when considered in connection with the accompanying drawings, wherein.

DETAILED DESCRIPTION

Figure 1:
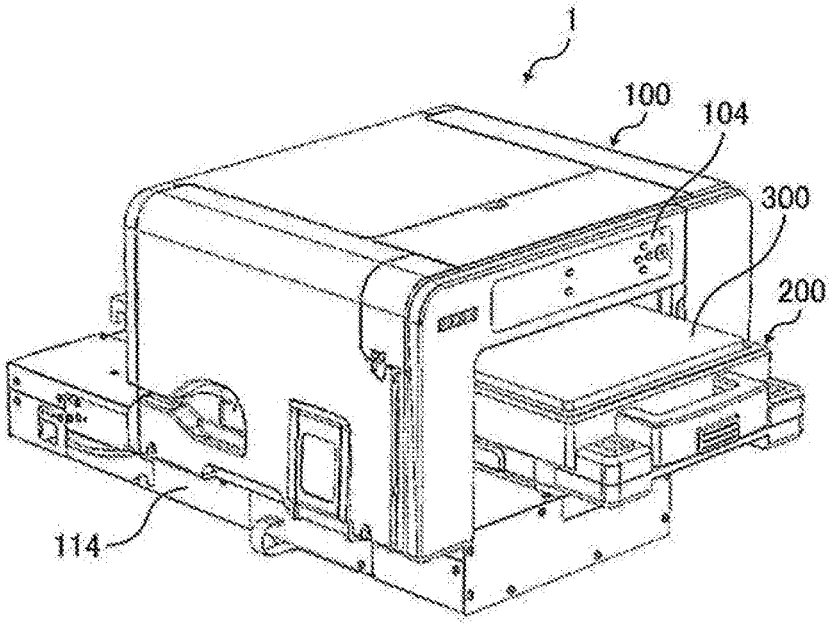
FIG. 1 is a perspective view schematically illustrating an exemplary exterior of a printer that adds an image to a cloth according to one embodiment of the present disclosure.
Figure 2:
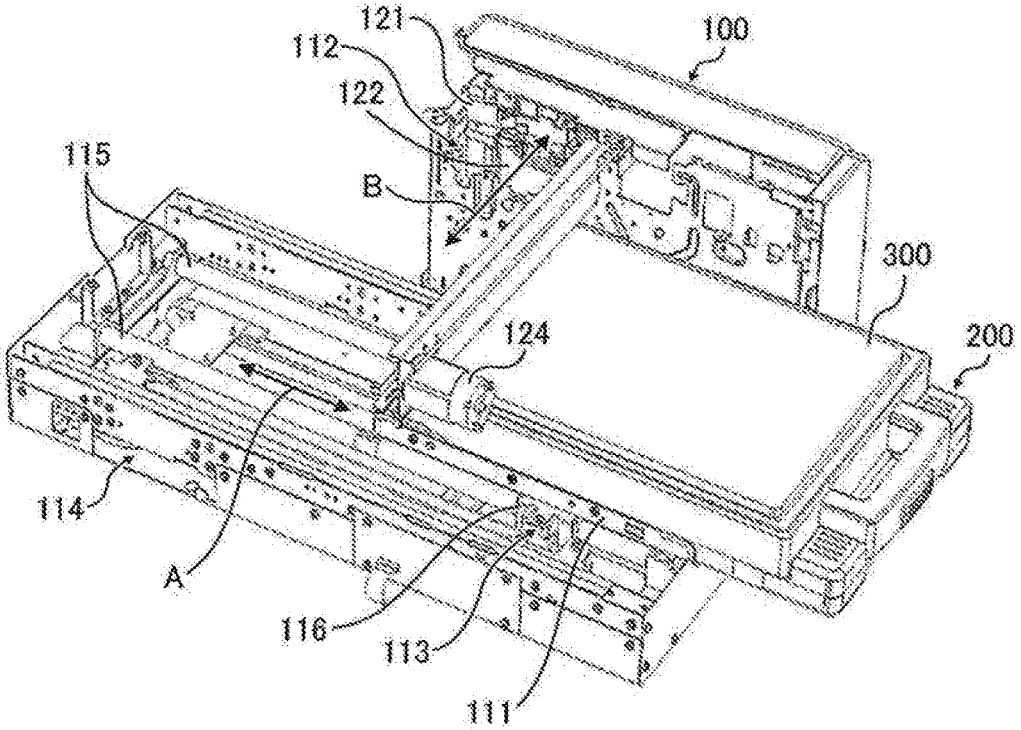
FIG. 2 is a perspective view illustrating an entire configuration of the printer according to one embodiment of the present disclosure.
Figure 3:
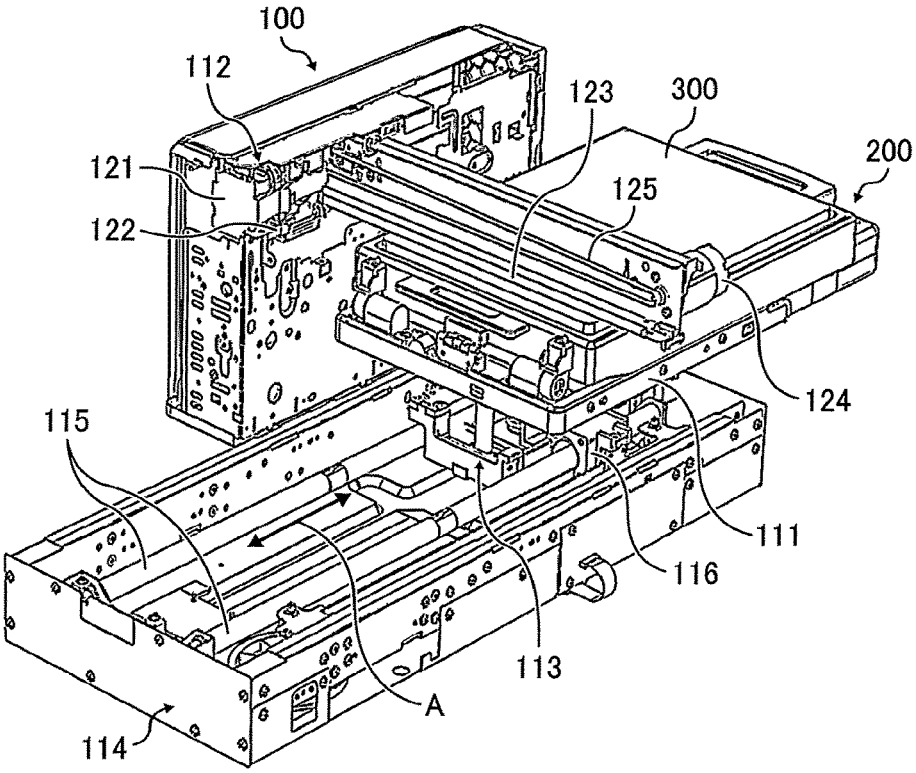
FIG. 3 is a perspective view schematically illustrating the entire configuration of the printer taken from a direction different from that of a view of FIG. 2 according to one embodiment of the present disclosure.

Referring now to the drawings, wherein like reference numerals designate identical or corresponding parts throughout the several views thereof, and in particular to FIGS. 1 to 3, one example of a printer that constitutes an image adding system to add an image to a cloth is initially described according to one embodiment of the present disclosure.

FIG. 1 schematically illustrates a perspective view of an exemplary exterior of a printer that adds an image to a cloth. FIG. 2 schematically illustrates a perspective view of an entire configuration of the printer. FIG. 3 schematically illustrates a perspective view of the entire configuration of the printer taken from a direction different from a direction in which the view of FIG. 2 is taken.

The printer 1 includes a stage 111 acting as a cassette receiver to detachably hold a cassette 200, which is a tray (as a cloth holder) to hold a cloth 400 to which an image is added (see FIG. 6), and moves with the cassette 200 back and forth (i.e., reciprocates) in a device body 100. The printer 1 also includes a printing unit 112 that prints an image on the cloth 400 held on the cassette 200 also held on the stage 111 in the device body 100 as well.

As the cloth 400, not only a cloth formed in one sheet such as a handkerchief, a towel, etc., but also a cloth processed as a garment such as a T-shirt, a sweatshirt, etc., and a cloth constituting a part of a product, such as a tote bag, etc., are employed as well. The printer 1 further includes an operation panel 104 be operated by an operator, for example, to input the number of printing sheets.

A carrier structure 113 is movably held on the device body 100 to move in a direction indicated by a double-headed arrow A (i.e., a carrying direction). The stage 111 is disposed on the carrier structure 113. The device body 100 includes a bottom housing 114 at a bottom thereof. A pair of carrier guides 115 is placed in the bottom housing 114 along the direction indicated by arrow A. A pair of sliders 116 is correspondingly provided in the carrier structure 113 and is movably held by the pair of carrier guides 115, respectively.

The printing unit 112 includes a carriage 121 that moves on the stage 111 in directions indicated by double-headed arrow B (i.e., in main scanning directions). The printing unit 112 also includes a head 122 mounted on the carriage 121 as well. The carriage 121 is movably held by a guide 123 also extended in the direction indicated by arrow B and is rendered to reciprocate in both directions indicated by arrow B by a driving motor 124 that transmits driving force thereto through a scanning mechanism such as a timing belt 125, etc. The head 122 is typically a liquid discharge head that forms an image by discharging ink on a surface of a cloth. However, the present disclosure is not limited to the head 122.

In this printer 1, after the cloth 400 is set to the cassette 200, the cassette 200 is mounted and held by the stage 111 located within the device body 100. Then, by repeatedly moving the head 122 in the directions indicated by double-headed arrow B while moving the stage 111 in one direction show by double-headed arrow A, a prescribed image is printed on the cloth 400.

Figure 4:
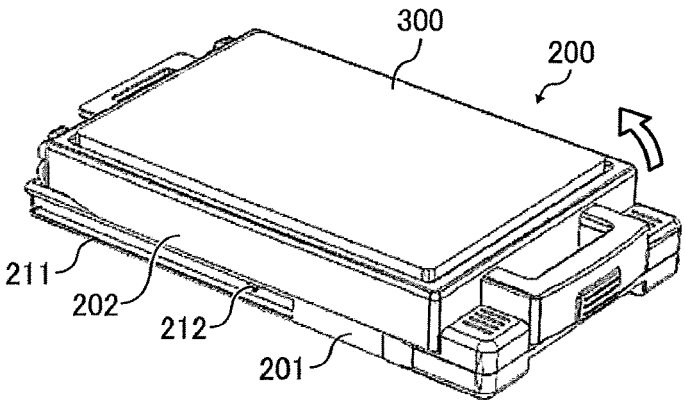
FIG. 4 also is a perspective view schematically illustrating an exemplary cassette acting as a tray according to one embodiment of the present disclosure.
Figure 5:
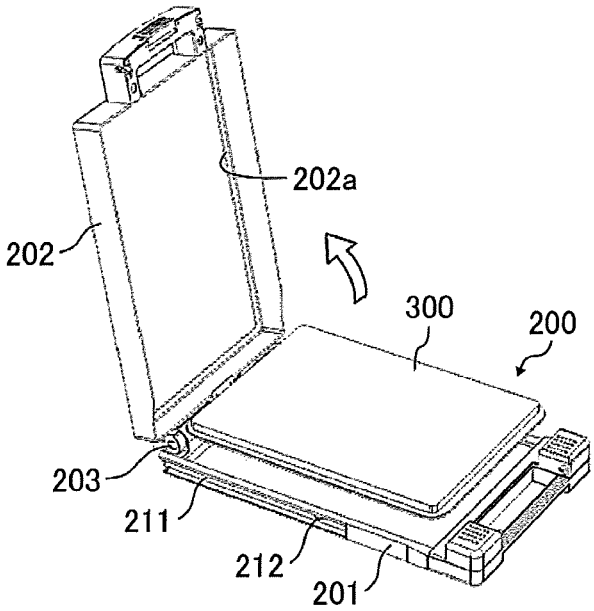
FIG. 5 is a perspective view illustrating an exemplary status of the cassette when a cover of the cassette is opened according to one embodiment of the present disclosure.
Figure 6:
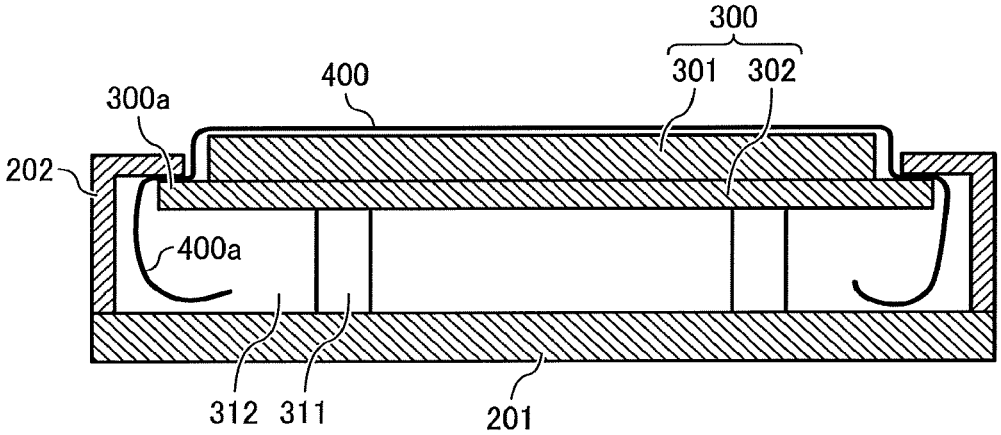
FIG. 6 is a cross-sectional view illustrating the cassette taken along a short direction of the cassette according to one embodiment of the present disclosure.

Now, with reference to FIGS. 4 to 6, one example of a cassette as a tray according to present disclosure is herein below described in detail. That is, FIG. 4 is a perspective view of the cassette. FIG. 5 also illustrates a perspective view of the cassette when a peripheral cover of the cassette is opened. FIG. 6 is a cross-sectional view of the cassette taken along a short direction of the cassette.

The cassette 200 includes a cassette base 201 as a tray base, and a platen 300 that acts as a cloth holder to hold a part of the cloth 400 flat to be printed thereon.

The platen 300 is configured by a platen structure 302 and a heat insulator 301 that constitutes a plane that holds the cloth 400 flat thereon. The heat insulator 301 has a heat resistance resistant to heat applied by a fixing device 5 described later in detail.

A platen peripheral cover 202 acting as the peripheral cover is attached to the cassette base 201 via a pair of hinges 203 and is openable in a direction indicated by an arrow illustrated in FIG. 5. The platen peripheral cover 202 has an opening 202*a* in a portion corresponding to the platen 300, and presses the cloth 400 against a flange section 300*a* (i.e., an outer circumferential edge of the platen structure 302) of the platen 300.

The platen 300 is supported above the cassette base 201 by multiple supporters 311 extending from the cassette base 201. Hence, the cassette base 201 and the platen 300 collectively form a cloth accommodating space 312 between these members to accommodate a surplus portion 400*a* of the cloth 400. For example, the surplus portion 400*a* may be both sleeves, a collar mouth, and a bottom edge or the like of a T-shirt when a front side of the T-shirt is printed.

Here, the platen 300 is detachably attached to the cassette base 201 and replaceable. With this, when multiple platens 300 are prepared, a piece of clothing to be printed next is previously wrapped around one of the multiple platens 300 not used in a current printing. Hence, the printing of an image onto the next cloth can be started quickly by simply replacing the used platen 300 with a new platen 300 after printing and fixing processes currently executed for the clothing are completed.

When the cloth 400 is set to the cassette 200, the platen peripheral cover 202 is opened and the cloth 400 is set onto (i.e., held by) the platen 300 as illustrated in FIG. 5. Subsequently, the platen peripheral cover 202 is closed as illustrated in FIG. 4 while a surplus portion (i.e., a portion not printed) 400*a* of the cloth 400 is accommodated in an cloth accommodating space 312 as illustrated in FIG. 6.

When an image is printed on the cloth 400, the cassette 200 is attached (set) to the stage 111 in the device body 100 as illustrated in FIG. 1.

In this way, since the cloth 400 to be printed is set onto the platen 300 when the cassettes 200 is wholly drawn out of the device body 100 of the printer 1, setting work of setting the cloth 400 to the platen 300 becomes easier.

Figure 7:
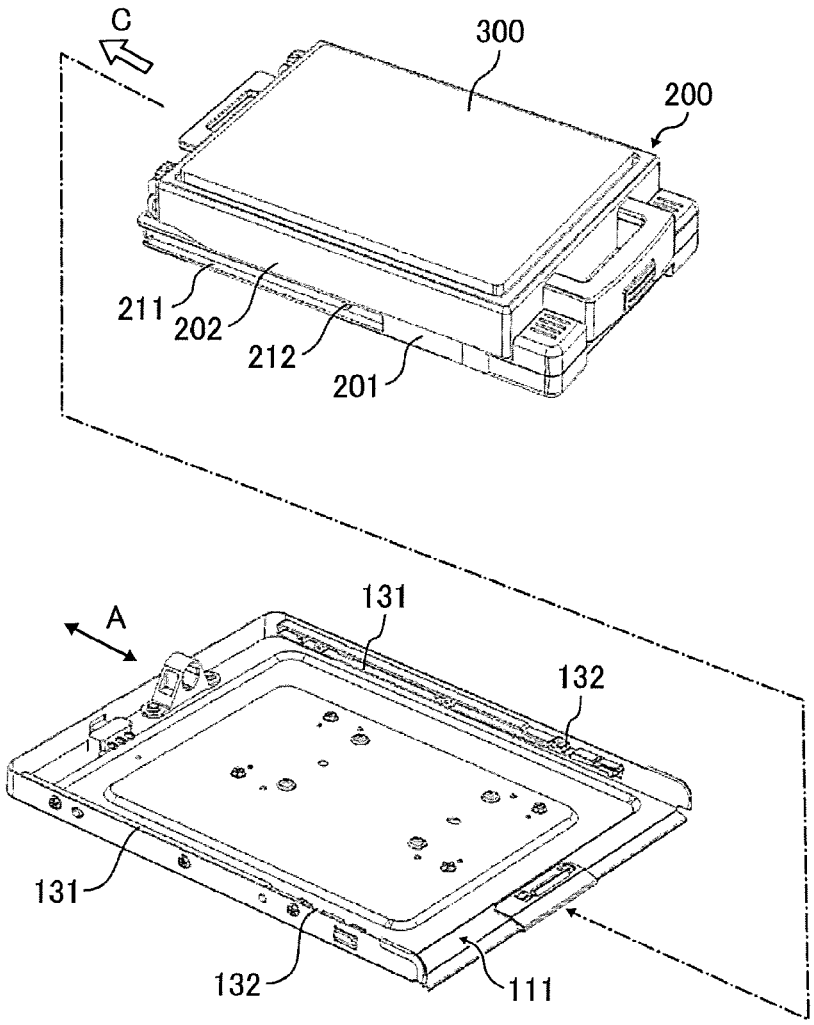
FIG. 7 is a perspective view illustrating an exemplary configuration of the cassette and a stage thereof according to one embodiment of the present disclosure.
Figure 8:
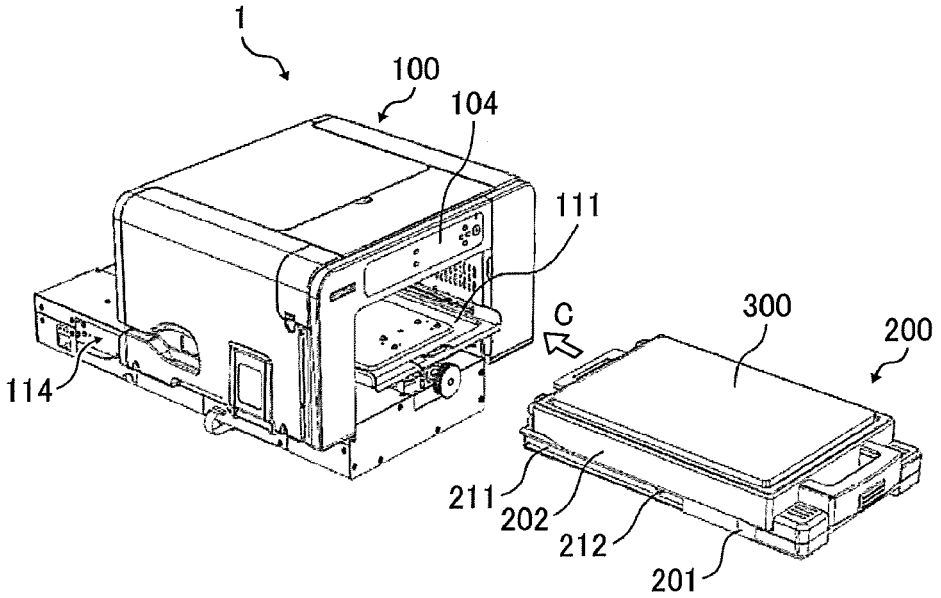
FIG. 8 also is a perspective view illustrating an exemplary aspect of the printer when the cassette is attached to the stage according to one embodiment of the present disclosure.
Figure 9:
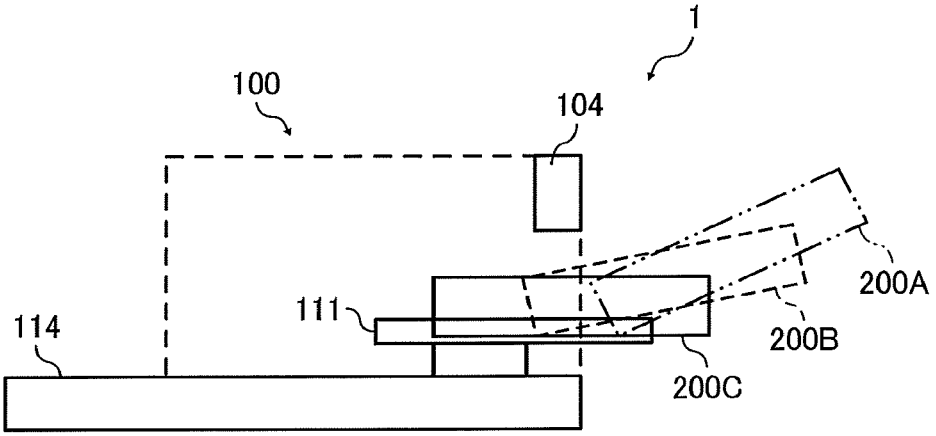
FIG. 9 is a diagram schematically illustrating an exemplary aspect of the printer when the cassette is attached to the stage according to one embodiment of the present disclosure.

Now, with reference to FIGS. 7 to 9, a mechanism of installing a cassette into the printer 1 is described in detail.

FIG. 7 illustrates a perspective view of an exemplary configuration of the cassette and a stage of the printer 1 of this embodiment of the present disclosure. FIG. 8 also illustrates a perspective view of an exemplary aspect when the cassette is attached to the stage of the printer 1 of this embodiment of the present disclosure. FIG. 9 is a cross-sectional view schematically illustrating an exemplary aspect when the cassette is attached to the stage of the printer 1 of this embodiment of the present disclosure.

As illustrated in FIG. 7, a pair of guide rails 131 and 131 is disposed at both ends of the stage 111 of the device body 100 in a direction perpendicular to the direction indicated by arrow A in which the stage 111 moves. At both sides of the cassette 200, a pair of grooves 211, into which the pair of guide rails 131 and 131 movably (i.e., slidingly) fits, respectively, is disposed correspondingly.

A pair of depressions 132 and 132 is also disposed at both ends of the stage 111 in the direction perpendicular to the direction in which the stage 111 moves as indicated by arrow A. At positions of the depressions 132 and 132 (i.e., sliding end positions), the pair of grooves 211 and 211 stop moving along the pair of guide rails 131 and 131, respectively, in the direction indicated by arrow A. That is, the cassette 200 has a pair of convex portions 212 and 212 that fits into the pair of depressions 132 and 132 of the stage 111, respectively. Accordingly, these depressions 132 and 132 and the convex portions 212 and 212 collectively constitute a securing device that secures the cassette 200 and the stage 111 with each other when the cassette 200 is slid and set to the stage 111.

As configured in this way, when the cassette 200 with the platen 300 holding the cloth 400 thereon is to be attached to the stage 111 of the device body 100, the cassette 200 is slid and installed in the stage 111 in a direction indicated by arrow C along the direction of the movement of the stage 111 (i.e., the direction indicated by arrow A) as illustrated in FIG. 8.

Now, a procedure of installing the cassette 200 in the stage 111 is more specifically described with reference to FIG. 9.

First, a front edge of the cassette 200 is placed on the stage 111 indicated by a two-dot chain line 200A. Subsequently, as indicated by a broken line 200B, the cassette 200 is further slid and deeply pressed in the direction indicated by arrow C with its pair of grooves 211 and 211 fitting into the pair of guide rails 131 and 131 of the stage 111, respectively.

Subsequently, when the cassette 200 is further pressed up to a sliding end indicated by a solid line 200C, the convex portions 212 and 212 of the cassette 200 fit into the depressions 132 of the stage 111, respectively, thereby completing the installation of the cassette 200 in the stage 111.

Hence, since the cassette 200 can be mounted on the stage 111 in the same direction as the stage 111 moves, the device body 100 (i.e., the printer 1) can be more effectively downsized than a device body, in which the cassette 200 is mounted on the stage 111 from right above the stage 111, because the stage 111 does not need to completely moves out of the device body 100 and is exposed to an outside thereof.

Now, an exemplary aspect when a power source stops supplying power to the printer 1 that accommodates the cassette 200 in the device body 100 is described with reference to FIG. 10.

Figure 10:
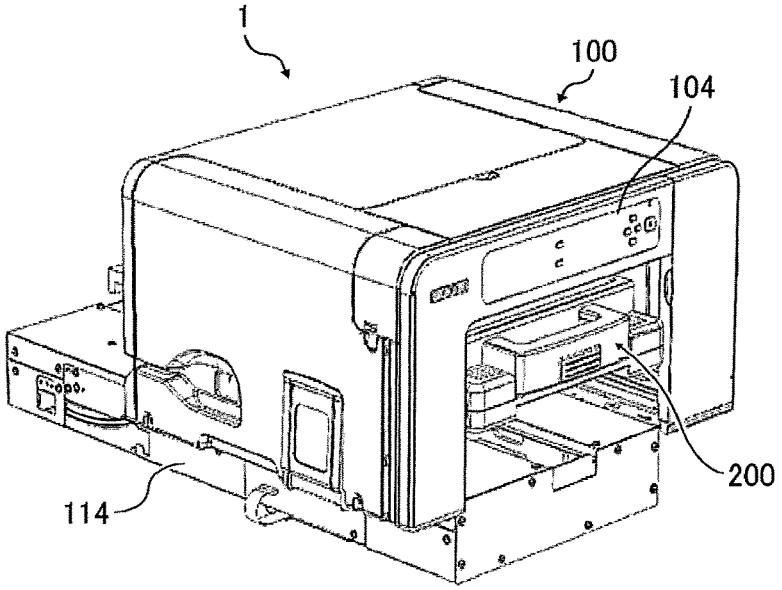
FIG. 10 is a perspective view illustrating an exemplary aspect of the printer when the cassette is attached to a device body during a power off state according to one embodiment of the present disclosure.

FIG. 10 is a perspective view of an exemplary appearance of the printer 1.

On receiving an instruction to stop supplying power to the device body 100 of the printer 1, a controller enables the stage 111 to move to a position at which a front side of the cassette 200 (i.e., a back side in a direction in which a cassette is attached) almost aligns with a front side of the device body 100 in planar view as illustrated in FIG. 10. After that, a power switch is turned off.

With this, the footprint of the printer 1 can be effectively reduced during a waiting time.

Figure 11:
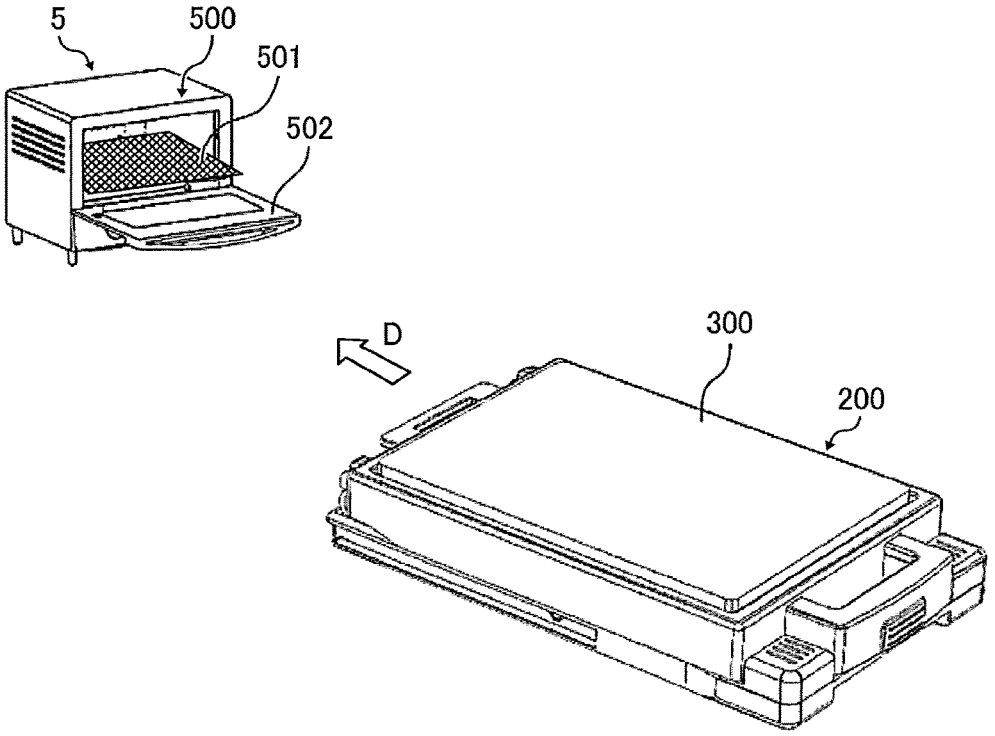
FIG. 11 is a perspective view illustrating an exemplary exterior of a fixing device that constitutes an image adding system to add an image to the cloth while applying heat to the cloth according to one embodiment of the present disclosure.
Figure 12:
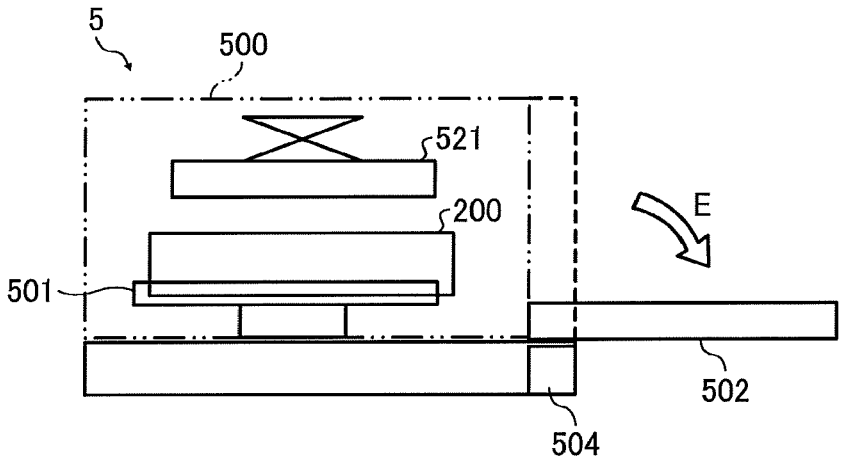
FIG. 12 is a diagram illustrating an exemplary configuration of an interior of the fixing device of FIG. 11.
Figure 13:
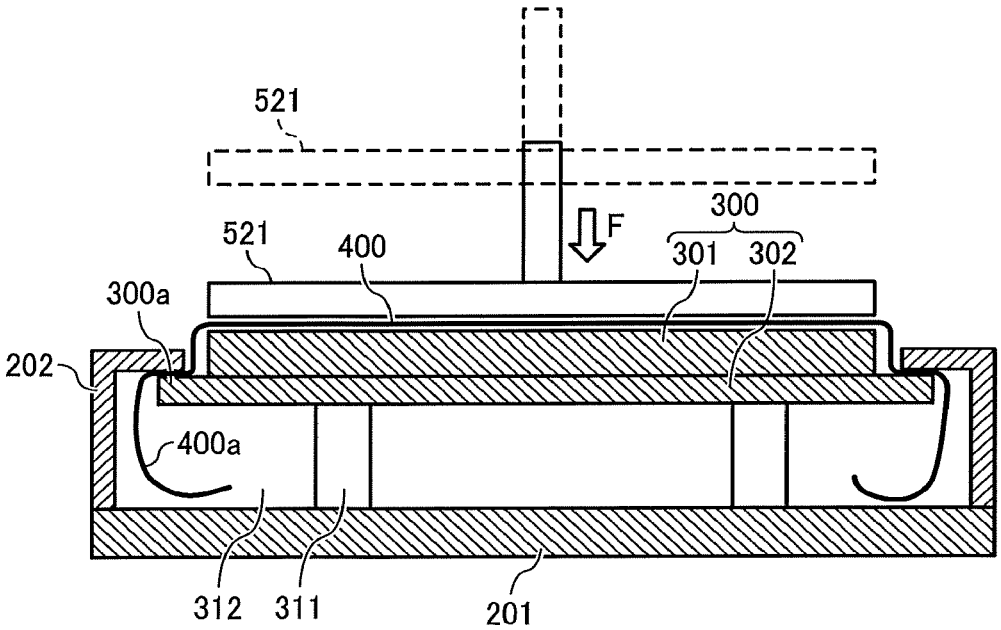
FIG. 13 is a cross-sectional view illustrating the cassette and surrounding thereof taken along a short direction of the cassette when a fixing process is executed according to one embodiment of the present disclosure.

Now, with reference to FIGS. 11 to 13, an exemplary fixing device that constitutes an image adding system to add an image to a cloth by applying heat thereto is described.

FIG. 11 is a perspective view of an exemplary appearance of a fixing device 5 that executes fixing by applying heat to the cloth. FIG. 12 illustrates an exemplary configuration of an interior of the fixing device 5 of FIG. 11. FIG. 13 is a cross-sectional view illustrating a cassette 200 and surroundings of the cassette 200 taken along a widthwise direction of the cassette when the fixing device 5 currently executes a fixing process.

A fixing device 5 applies heat to a cloth 400 held on a platen 300 of the cassette 200. For this purpose, the fixing device 5 includes a cassette receiver 501 to which a cassette 200 is detachably attached as set to the above-described printer 1. The fixing device 5 also includes a hot press unit 521 as a contact type heater that applies pressure and heat to the cloth 400 in a body 500 of the fixing device 5. Hence, the hot press unit 521 requires relatively high temperature of about 130 degrees or more, preferably about 150 degrees or more, for fixing.

A heat insulator 301 is included in the platen 300 and has heat resistance to resist heat having a prescribed degree of temperature (i.e., a fixing temperature) applied by the hot press unit 521 of the fixing device 5.

In this way, since a surface contacting the cloth 400 on the platen 300 is made of heat insulator, heating performance of the hot press unit 521 becomes effective, because heat to be applied to the cloth 400 does not leak to either a platen structure 302 or an interior of the cassette 200.

The heat insulator 301 can be made of heat-resistant sponge rubber made of silicone rubber, fluorocarbon rubber, various types of heat-resistant resin, felt, silicate calcium board, Kalhon, Kal Light, gypsum board, melamine sponge, glass wool, and glass or the like. Since it is required to have certain measures of hardness and heat resistance to hold the platen 300 flat, the platen structure 302 is preferably composed of either a metal plate or a glass plate and the like. Furthermore, different from a configuration illustrated in FIG. 13, the heat insulator 301 and the platen structure 302 are not necessarily independent (i.e., different bodies), and can be integrated together to constitute a single part.

The hot press unit 521 has a size sufficient to cover and contact the cloth 400 lying on the platen 300 (i.e., in a region of the heat-resistant platen structure 302).

Further, an openable cover 502 and an operation unit 504 are disposed on a front side of the body 500 of the fixing device 5. More specifically, the operation unit 504 is disposed at a position not to be operated unless the openable cover 502 is closed. In this example, the openable cover 502 is enabled to tilt to a front side, and the operation unit 504 is placed at a bottom of a front face of the body 500 of the fixing device 5.

With this, a risk that an operator accidentally touches the operation unit 504 and the hot press unit 521 starts operation accordingly and contacts the operator during installation of the cassette 200 can be avoided.

A structure for attaching and detaching the cassette 200 to and from a cassette receiver 501 is similar to that for attaching and detaching the cassette 200 to and from the stage 111 also acting as a cassette receiver in the above-described printer 1.

Hence, when the cloth 400 is to be set to the fixing device 5, the cassette 200 holding the cloth 400 with an image printed thereon is removed from the printer 1 as described above, and the openable cover 502 is then opened in a direction indicated by arrow E in FIG. 12. Subsequently, the cassette 200 is inserted into the cassette receiver 501 of the fixing device 5 in a direction indicated by arrow D in FIG. 11 and is finally held by the cassette receiver 501. Here, the cassette 200 is slid and set to the cassette receiver 501.

Then, the hot press unit 521 is lowered in a direction indicated by arrow F in FIG. 13, and is depressed against the cloth 400 held on the platen 300 with the image printed thereon to heat the cloth 400 with the image.

Hence, the cassette 200 holding the cloth 400 thereon is shared by both the printer 1 and the fixing device 5 as well.

With this, the printed cloth 400 can be set to the fixing device 5 keeping the same state as that in the printing operation. Hence, even when the printed cloth 400 is carried, the printed cloth 400 does not wrinkle or even partially overlap thereby preventing distortion of a printing surface of the printed cloth 400. Hence, efficiency of setting work of setting the cloth 400 by an operator greatly improves.

In addition, since the platen 300 holding the cloth 400 in the cassette 200 has a heat resistance to resist heat of the fixing device 5, the platen 300 does not deform or cause a similar problem due to the heat.

As described heretofore, the fixing device 5 of this embodiment of the present disclosure is configured by using the hot press unit 521. However, the present disclosure is not limited to a type of the hot press unit 521 and can employ a different system, in which a cloth 400 may be heated by a non-contact type heater as well. For example, a planar heater is located adjacent to a surface of the cloth 400 at a distance of about 2 mm to about 3 mm to apply radiant heat thereto.

Although the cassette 200 is shared by both the printer 1 and the fixing device 5 as described heretofore, the present disclosure is not limited thereto. For example, when a preprocessing device applies thermo-pressing to a surface of the cloth 400 as a preprocessing process before printing to reduce fuzz of the cloth 400, the cassette 200 may be shared by both the preprocessing device and the printer 1 as well. That is, the preprocessing device acts as a heater to heat the cloth. Further, the same cassette 200 can be utilized in each of processes of the preprocessing device, the printer, and fixing device as well.

Further, the printer 1 and a fixing device 5 or the like are placed side by side to share the cassette 200 and continuously apply respective processing operations to the cassette 200. In such a situation, since the same cassette 200 is commonly used, transportation thereof between these devices can be automated. In addition, when each of devices such as the printer 1, the fixing device 5, etc., is downsized by using the cassette 200, multiple devices can be installed at the same time together in a single housing.

Although the printer 1 constitutes the image adding system together with the heater (e.g., the fixing device 5 or the like) to heat the cloth as described heretofore, the printer 1 is not necessary configured as the system and can be installed alone as long as the printer 1 can share the same cloth holder (e.g. the cassette 200) with the heater.

Now, another exemplary cassette of a second embodiment of the present disclosure is described with reference to FIG. 14.

Figure 14:
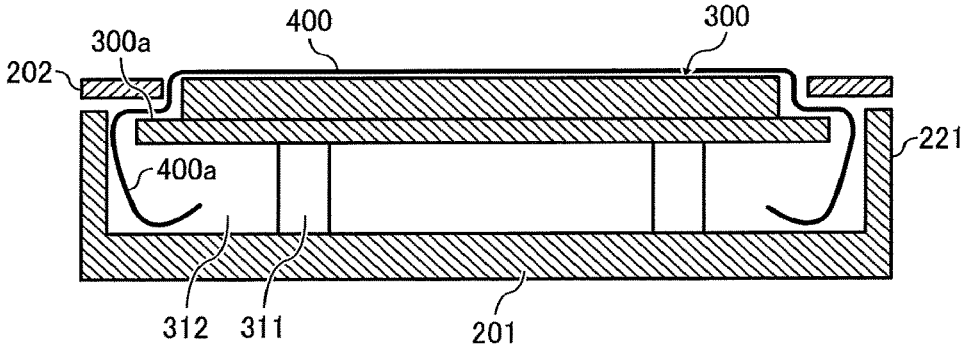
FIG. 14 also is a cross-sectional view illustrating a cassette taken along a short direction of the cassette according to a second embodiment of the present disclosure.

FIG. 14 illustrates a cross-section of the cassette of the second embodiment of the present disclosure when viewed in a short direction thereof again.

As illustrated there, a pair of walls 221 stands up from respective edges of a cassette base 201 of a cassette 200 to form side walls of a cloth accommodating space 312.

A platen peripheral cover 202 has an opening that faces a platen 300 thereby constituting a planar frame.

With this configuration, even when the platen peripheral cover 202 is opened, an extra piece (i.e., a surplus portion) 400*a* of a cloth 400 can be reliably accommodated inside the cassette 200 due to provision of the side walls 221. That is, it can be prevented that the surplus portion 400*a* of the cloth 400 is sandwiched between the platen peripheral cover 202 and the cassette base 201 even when the surplus portion 400*a* of the cloth 400 protrudes.

Figure 15:
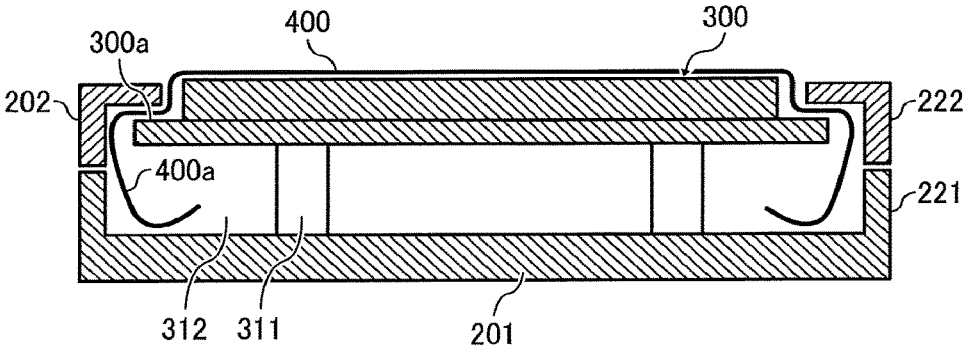
FIG. 15 also is a cross-sectional view illustrating a cassette taken along a short direction of the cassette according to a third embodiment of the present disclosure.

Now, yet another exemplary cassette of a third embodiment of the present disclosure is described with reference to FIG. 15. That is, FIG. 15 illustrates a cross-section of the cassette of the third embodiment of the present disclosure when viewed in a short direction thereof again.

A pair of side walls 221 stands up from respective edges of a cassette base 201 of a cassette 200 to partially form side walls of a cloth accommodating space 312. Another pair of walls 222 downwardly extends from respective edges of a platen peripheral cover 202 to partially form the side walls of the cloth accommodating space 312 again.

This arrangement can prevent protrusion of the surplus portion 400*a* of the cloth 400 while widening a gap (i. e., an interval) between the platen 300 and each of the side walls 221 used to allow the surplus portion 400*a* of the cloth 400 to enter the cloth accommodating space 312 more than that used in the second embodiment of the present disclosure. Accordingly, work to accommodate the surplus portion 400*a* of the cloth 400 into the cloth accommodating space 312 becomes easier.

Now, yet another exemplary cassette of a fourth embodiment of the present disclosure is described with reference to FIG. 16.

Figure 16:
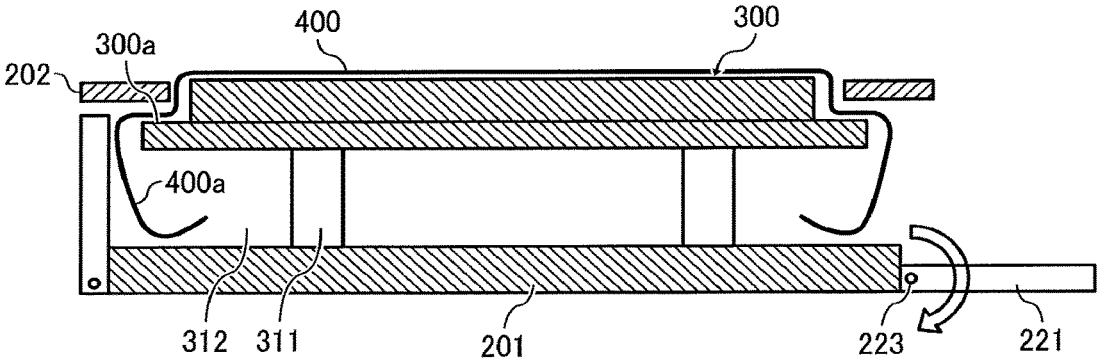
FIG. 16 also is a cross-sectional view illustrating a cassette taken along a short direction of the cassette according to a fourth embodiment of the present disclosure.

FIG. 16 illustrates a cross-section of the cassette of the fourth embodiment of the present disclosure when viewed in a short direction thereof.

A pair of openable side walls 221 partially forming side walls of a cloth accommodating space 312 is attached to shafts 223 at respective edges of a cassette base 201 of a cassette 200.

With this, protrusion of a surplus portion 400*a* of a cloth 400 can be prevented as in the second embodiment of the present disclosure while securing gaps used to accommodate the surplus portions 400*a* of the cloth 400 in the cloth accommodating space 312 as in the first embodiment of the present disclosure as well. Accordingly, work to accommodate the surplus portion 400*a* of the cloth 400 in the cloth accommodating space 312 becomes easier still.

Specifically, by tilting the side wall 221 (or side walls 221 and 221) and then setting the cloth 400 onto a platen 300, the surplus portion 400*a* thereof can be more effectively accommodated in the cloth accommodating space 312 at the same time. In addition, by raising the side wall 221 (or the side walls 221 and 221) after that before closing the platen peripheral cover 202, the surplus portion 400*a* is reliably accommodated in the cloth accommodating space 312 of the cassette 200, thereby reliably preventing the surplus portion 400*a* from protruding therefrom.

Now, yet another exemplary cassette of a fifth embodiment of the present disclosure is described with reference to FIGS. 17 and 18.

Figure 17:
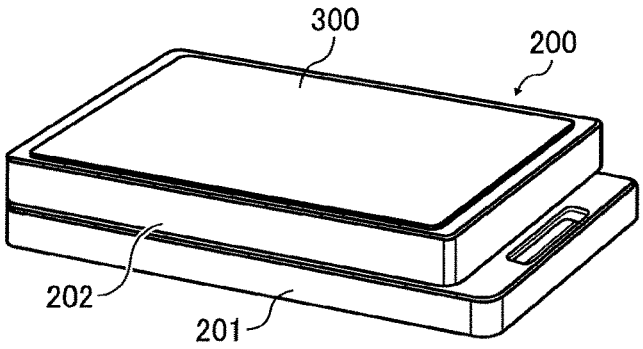
FIG. 17 is a perspective view illustrating an exemplary cassette according to a fifth embodiment of the present disclosure.
Figure 18:
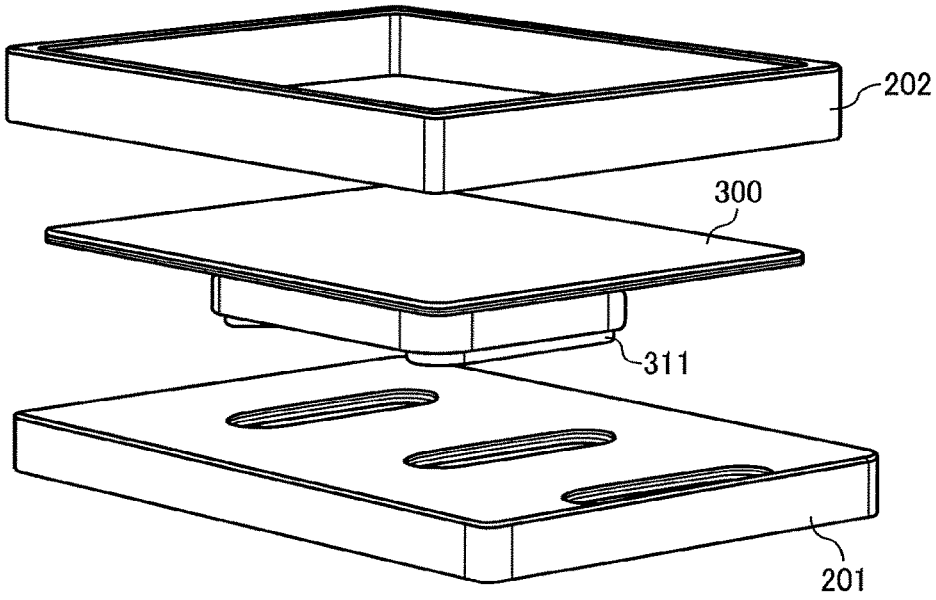
FIG. 18 is a perspective exploded view illustrating the cassette of FIG. 17 when a cloth is held thereon according to the fifth embodiment of the present disclosure.

FIG. 17 is a perspective view of an exemplary cassette according to fifth embodiment of the present disclosure. FIG. 18 is also a perspective view of an exemplary exploded state of the cassette of FIG. 17 when a cloth is held on the cassette.

A platen 300 is detachably attached to a cassette base 201 of a cassette 200. In addition, a platen peripheral cover 202 is enabled to be detachable from the cassette base 201 and fit with an outer circumferential edge (i.e., the flange section 300*a* of the platen structure 302 (see FIG. 13)) of the platen 300.

Now, a method of attaching the cloth 400 to the cassette 200 of the fifth embodiment of the present disclosure is herein below described with additionally reference to FIGS. 19A to 19C.

Figure 19A:
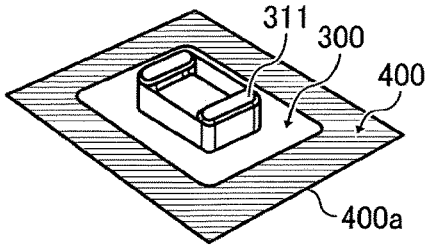
FIGS. 19A, 19B, and 19C are perspective views collectively illustrating a method of attaching a cloth to the cassette to be used according to the fifth embodiment of the present disclosure.
Figure 19B:
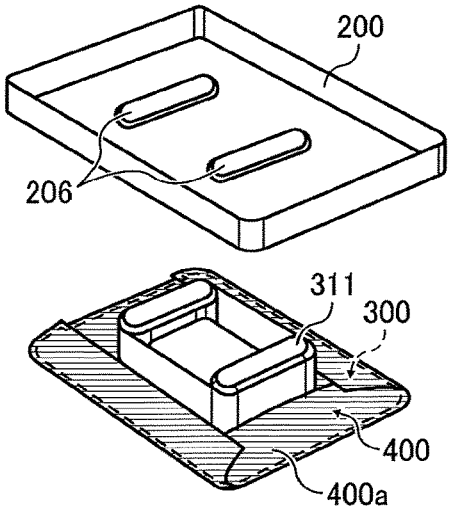
Figure 19C:
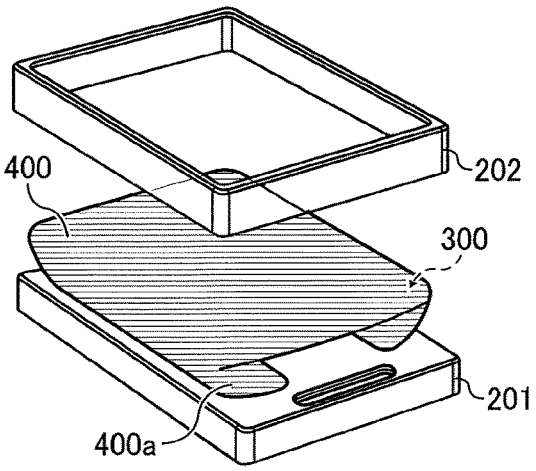

FIGS. 19A, 19B, and 19C collectively illustrate exemplary steps of attaching the cloth 400 to the cassette 200 according to this embodiment of the present disclosure.

As described above with reference to FIG. 18, the platen 300 is initially removed from the cassette base 201. Then, as illustrated in FIG. 19A, the cloth 400 to be printed is spread with its back side (i.e., a face opposite a face to be printed) facing upward. Then, the platen 300 is placed on the back side of the cloth 400. Subsequently, as illustrated in FIG. 19B, a surplus portion 400*a* of the cloth 400 protruding from the platen 300 is folded to enter a back side of the platen 300.

At this moment, since the platen 300 is detached from the cassette base 201, a sufficient space needed to fold the cloth 400 can be secured around a section, to which the cloth 400 protrudes from the platen 300. Hence, the surplus portion 400*a* of the cloth 400 protruding from the platen 300 can be neatly folded.

Subsequently, as illustrated in FIGS. 19B and 19C, a pair of supporters (i.e., a pair of legs) 311 and 311 supporting the platen 300 fits into a pair of dents 206 formed on the cassette base 201, respectively. The platen peripheral cover 202 is then fitted with the periphery of the platen 300.

At this moment, since the surplus portion 400*a* of the cloth 400 protruding from a plane of the platen 300 is neatly folded, flatness of a printed section in the cloth 400 increases when an outer circumferential portion of the cloth 400 is pressed by the platen peripheral cover 202. This causes high quality printing.

Now, yet another exemplary cassette of a sixth embodiment of the present disclosure is described with reference to FIG. 20.

Figure 20:
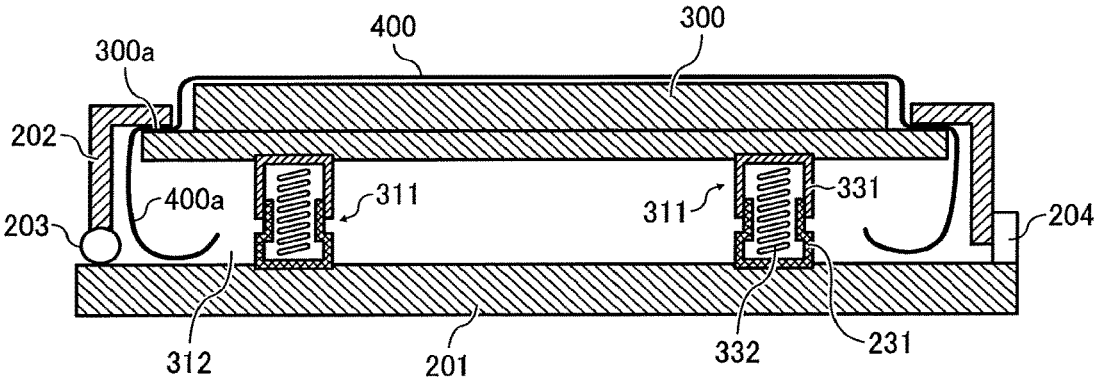
FIG. 20 is a cross-sectional view illustrating a cassette taken along a longitudinal direction of the cassette according to a sixth embodiment of the present disclosure.

FIG. 20 is a cross-sectional view of the cassette of the sixth embodiment of the present disclosure when viewed in a longitudinal direction thereof.

A pair of supporters 311 and 311 supporting a platen 300 is provided again and each of them includes a hollow pillar 231 disposed on a side of a cassette base 201 acting as a base and another hollow pillar 331 disposed on a side of a platen 300 to movably fit with the hollow pillar 231. Each of the pair of supporters 311 and 311 also includes a compression spring 332 disposed between the hollow pillar 231 and the other hollow pillar 331.

With this, the platen 300 is supported to be displaceable relative to the cassette base 201 (in other words, a distance (i.e., a height) from the cassette base 201 to the platen 300 is changeable).

A platen peripheral cover 202 is also provided in this embodiment of the present disclosure to act as a cover to cover a periphery of the platen 300 again. A lock 204 is also provided to regulate a height of the platen peripheral cover 202 from the cassette base 201. As illustrated in FIG. 20, a hinge 203 is located on the cassette base 201 to allow the platen peripheral cover 202 to pivot therearound. The lock 204 is located on the cassette base 201 on an opposite side to a side, at which the hinge 203 is located.

As configured in this way, when a cloth 400 (set to the platen 300) has a different thickness (e.g., thicker than an average), the platen 300 is depressed against restoring force of the spring 332 while changing the distance (i.e., the height) from the cassette base 201. Hence, the cassette of the sixth embodiment of the present disclosure can accommodate various cloths 400 having a different thickness.

In addition, with such a configuration, since the platen 300 is constantly pressed by a prescribed force against the platen peripheral cover 202, the cloth 400 is unlikely to deviate even when the cassette 200 is carried.

In addition, when a cloth 400 having a different thickness is set to the platen 300, the platen 300 is lowered to secure a prescribed gap between the platen 300 and the platen peripheral cover 202. Accordingly, a height of the platen peripheral cover 202 from the cassette base 201 does not change.

In other words, a height of a surface of the cloth 400 held on the platen 300 is specified based on the height of the platen peripheral cover 202 from the cassette base 201.

With this, a lock position, at which the platen peripheral cover 202 is locked regarding the cassette base 201 can be fixed by the lock 204. Hence, a configuration of the cassette 200 can be simplified. In addition, since the lock position does not change, an operator can easily handle the cassette as well.

Further, when the head 122 (see FIGS. 2 and 3) employs a liquid discharge head, the shorter the distance between the head 122 and an a surface of a printing objective, to which liquid is given, the higher the quality of an image formed on the surface of the printing objective, in general.

In view of this, the circumferential edge (i.e., the flange section 300*a* of the platen structure 302) of the movable platen 300 is pressed against the platen peripheral cover 202 to regulate the height of the surface of the cloth 400. Hence, a quality of the image can be improved even when the cloth 400 having a different thickness is laid on the movable platen 300.

In addition, when the platen 300 is displaceable in this way, it is preferable that the supporters 311 and 311 are supported on circumferential sides of the platen 300, respectively, to secure parallelism of the surface of the platen 300 with a moving plane on which the head 122 moves. However, in such a configuration, the supporters 311 and 311 may hamper accommodation of the surplus portion 400*a* of the cloth 400.

In view of this, the height of the surface of the cloth 400 held on the platen 300 is regulated by the platen peripheral cover 202 at the height thereof to either place the supporters 311 and 311 inside a width of the platen 300 or reduce the number of supporters 311 as well. Hence, the surplus portion 400*a* of the cloth 400 can be readily accommodated in the cloth accommodating space 312.

Now, yet another exemplary cassette of a seventh embodiment of the present disclosure is described with reference to FIG. 21.

Figure 21:
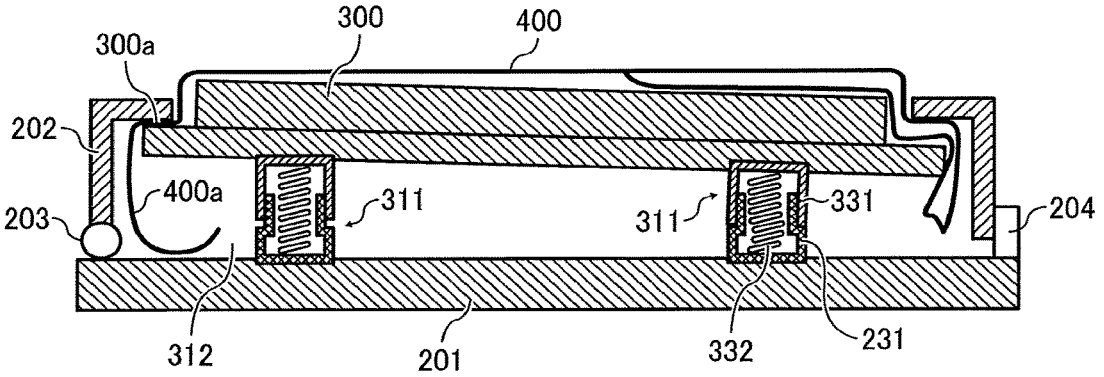
FIG. 21 also is a cross-sectional view illustrating a cassette taken along a longitudinal direction of the cassette according to a seventh embodiment of the present disclosure.

FIG. 21 is a cross-sectional view of the cassette of the seventh embodiment of the present disclosure when viewed in a longitudinal direction thereof again.

This embodiment of the present disclosure includes a similar configuration to the above-described sixth embodiment except for the following configuration. That is, in the seventh embodiment, the hollow pillars 231 disposed on the side of the cassette base 201 and the hollow pillars 331 disposed on the side of the platen 300 are respectively engaged with each other via plays (or vertical gaps) formed between these hollow pillars 231 and 331. Hence, the platen 300 can be displaced even in an inclined state.

With this, when a cloth 400 having a different thickness therein, such as a cloth 400 partially having a double layer (e.g., a pocket or the like) is printed, the platen 300 inclines and equalizes heights of thin and thick portions of the cloth 400 with each other as illustrated in the drawing.

With this, since the flatness of the surface of the cloth 400 facing the head 122 can be secured, a high quality image can be again printed on even a cloth 400 partially having a different thickness therein.

For the same reason, fine adjustment of a height generally needed in accordance with a condition of the cloth 400 to be printed, such as presence of overlapping of multiple portions, inclusion of a pocket, presence of overlapping of seam portions, etc., becomes unnecessary. Accordingly, performance of setting work of setting the cloth 400 to the platen 300 can be effectively improved.

Now, yet another exemplary cassette of an eighth embodiment of the present disclosure is described with reference to FIG. 22.

Figure 22:
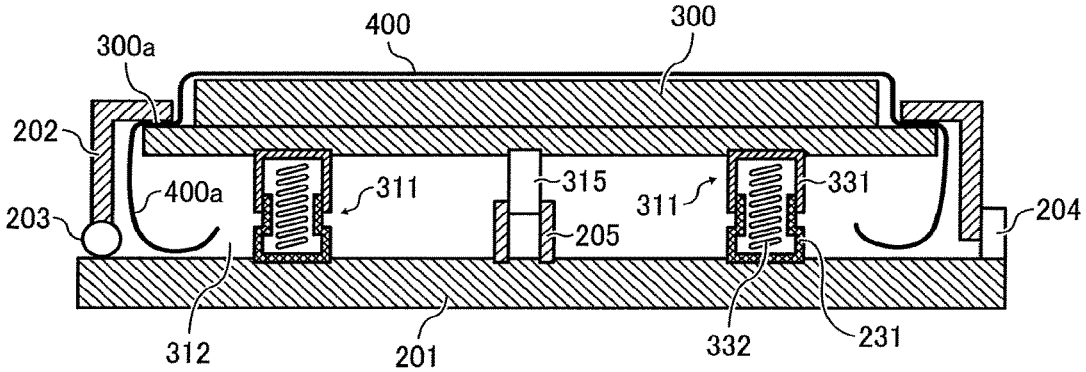
FIG. 22 is again a cross-sectional view illustrating a cassette taken along a longitudinal direction of the cassette according to an eighth embodiment of the present disclosure.

FIG. 22 is a cross-sectional view of the cassette of the eighth embodiment of the present disclosure when viewed in a longitudinal direction thereof again.

The cassette of this embodiment of the present disclosure at least includes the similar configuration to that of the cassette of the above-described sixth embodiment of the present disclosure. In addition, in the cassette of the eighth embodiment of the present disclosure, the platen 300 includes a guide rod 315 attached between two supporters 311 and 311. The cassette correspondingly includes a guide 205 on a side of the cassette base 201 to guide the guide rod 315. That is, the guide rod and the guide 205 collectively constitute a guide unit.

Such a configuration allows the platen 300 to precisely move when the platen 300 displaces. In addition, when the platen 300 displaces, a force transmitted from an edge of the platen 300 to the supporters 311 and 311 is absorbed, thus preventing corruption of the supporters 311 and 311. Hence, the number of supporters 311 and 311 can be reduced, and accordingly, workability of accommodating the surplus portion 400*a* of the cloth 400 in the cloth accommodating space 312 can be enhanced as well.

Now, yet another exemplary cassette of a ninth embodiment of the present disclosure is described with reference to FIG. 23.

Figure 23:
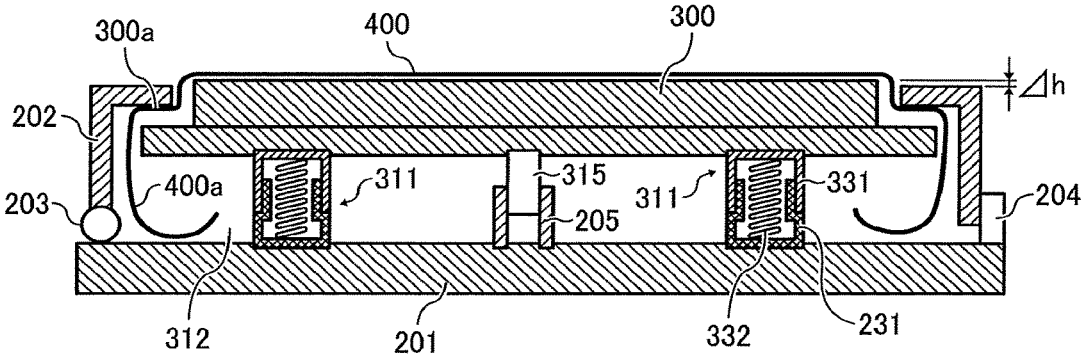
FIG. 23 is a cross-sectional view illustrating a cassette taken along a longitudinal direction of the cassette according to a ninth embodiment of the present disclosure.

FIG. 23 is a cross-sectional view of a cassette of the ninth embodiment of the present disclosure when viewed in a longitudinal direction thereof again.

The cassette 200 of this embodiment of the present disclosure includes the similar configuration to that of the cassette 200 of the above-described eighth embodiment of the present disclosure. As a difference, in this embodiment of the present disclosure, the cassette 200 is configured so that the platen 300 upwardly protrudes from the platen peripheral cover 202 by a length of Δh (delta h) when the platen 300 is lowered to a lower limit and the hollow pillar 231 accordingly hits against (i.e., contacts) the hollow pillar 331.

Hence, when a fixing process is applied to the cloth 400 by pressing the hot press unit 521 of the fixing device 5 against the cloth 400, since a prescribed pressure is given thereto, the fixing process is precisely executed.

That is, when the surface of the platen 300 is lowered below the surface of the platen peripheral cover 202 and the hot press unit 521 is then pressed, the cloth 400 held on the surface of the platen 300 no longer receives a required pressure from the hot press unit 521.

To solve such a problem, the lower limit of displacement of the platen 300 is regulated such that the surface of the platen 300 is not positioned lower than the surface of the platen peripheral cover 202 and the required pressure can be applied to the cloth 400.

Here, the above-described cloth holder of the present disclosure is sufficient if it can be detachably attached to the printer and the heater such as the fixing device, etc., that heats the cloth. That is, the shape or the like is not limited to a box type cassette as employed in the above-described various embodiments of the present disclosure. For example, as illustrated in FIG. 1 (only the printer 1 is illustrated), the cloth holder can be a sheet of a plate-like platen enabled to be inserted into the printer 1 and the heater such as the fixing device 5, etc., that heats the cloth as well.

Further, as a device to eliminate a process of setting the cloth (i.e., the T-shirt or the like) to the cloth holder every time when printing is executed thereby improving workability of printing, a cloth holder with the cloth already set thereto can be also used. In such a situation, the used cloth holder is collected and a fresh cloth holder with a cloth set thereto is provided again. That is, the used cloth holder is replaced with the fresh cloth holder. In this way, by setting and smoothly holding the cloth on the cloth holder and thereby constituting the cloth holder integral with the cloth thereon, the cloth holder integral with the cloth can be put in a market as a target of a commercial transaction.

Further, to obtain a similar advantage to that described above, instead of the above-described platen detachably attached to the cloth holder, a platen with a cloth (e.g., a T-shirt) already set thereto can be utilized as well. In such a situation, the platen with the cloth set thereto is attached to the cloth holder, and printing and/or fixing processes are then applied thereto. The platen is removed from the cloth holder when the printing and/or fixing processes are completed. Then, a fresh platen with a new cloth already set thereto is installed in the cloth holder, and printing and/or fixing process are similarly applied thereto. In such a situation, the used platen is collected and the fresh platen with the fresh cloth set thereto is provided again. Similar to that as described above, by setting and smoothly holding the cloth on the platen and thereby constituting the cloth holder with the cloth thereon, the sloth holder integral with the cloth can be put in the market as the target of the commercial transaction again.

With this, since an operator is not needed to newly set a cloth (e.g., T-shirt) every time, a continuous operation handling multiple sheets becomes easier and can be automated as well.

Numerous additional modifications and variations of the present disclosure are possible in light of the above teachings. It is therefore to be understood that within the scope of the appended claims, the present disclosure may be executed otherwise than as specifically described herein. For example, the image adding system is not limited to the above-described various embodiments and may be altered as appropriate. Similarly, the printer is not limited to the above-described various embodiments and may be altered as appropriate. Further, the cloth holder is not limited to the above-described various embodiments and may be altered as appropriate. Furthermore, the holder is not limited to the above-described various embodiments and may be altered as appropriate again.

What is claimed is:

1. An image adding system comprising:

a cloth holder to mechanically hold a cloth in a printing position in which an image is to be added by printing to a portion of the cloth held flat by the cloth holder;

a printer to print the image on the portion of the cloth held flat by the cloth holder; and a heater to heat the cloth, the heater being arranged at a position different from the printer, wherein the cloth holder is configured to be used by both the printer and the heater, wherein the cloth holder includes a pair of grooves each on an opposite side of the cloth holder, wherein the printer includes a first holder receiver configured to slide along the pair of grooves, wherein the heater includes a second holder receiver configured to slide along the pair of grooves, and wherein the cloth holder is configured to be alternately detachably attached to the printer and to the heater via the pair of grooves while the cloth holder mechanically holds the cloth in the printing position in which the image is to be added to the portion of the cloth.

2. The image adding system according to claim 1, wherein the cloth holder has a platen to hold flat the portion of the cloth to be printed, wherein the platen is configured to resist heat up to a prescribed temperature at which the heater heats the cloth, and wherein a face of the platen facing the cloth is made of heat insulating material.

3. The image adding system according to claim 1, wherein the heater heats the portion of the cloth bearing the image.

4. The image adding system according to claim 1, wherein the cloth holder is movable along the first holder receiver via the pair of grooves.

5. The image adding system according to claim 1, wherein the cloth holder is movable along the second holder receiver via the pair of grooves.

6. The image adding system according to claim 1, wherein the first holder receiver of the printer and the second holder receiver of the heater have similar shapes.

7. The image adding system according to claim 1, wherein the heater is a contact heater configured to contact and heat the cloth, and wherein the contact heater contacts only a part or parts of the cloth mechanically held by the cloth holder.

8. The image adding system according to claim 1, wherein the first holder receiver includes a pair of guide rails configured to slide along the pair of grooves of the cloth holder.

9. A printer usable in an image adding system that includes a heater to heat a cloth, the printer being arranged at a position separate from the heater and comprising:

a cloth holder to mechanically hold the cloth in a printing position in which an image is to be added by printing to a portion of the cloth held flat by the cloth holder;

a holder receiver to detachably hold the cloth holder; and a printing unit to print the image on the portion of the cloth held flat by the cloth holder, wherein the cloth holder includes a pair of grooves each on an opposite side of the cloth holder, wherein the holder receiver is configured to slide along the pair of grooves, and wherein the cloth holder is configured to be alternately detachably attached to the printer and to the heater via the pair of grooves while the cloth holder mechanically holds the cloth in the printing position in which the image is to be added to the portion of the cloth.

10. The printer according to claim 9, wherein the cloth holder includes:

a base;

a platen to hold flat the portion of the cloth to be printed;

an outer peripheral cover to sandwich the cloth between the outer peripheral cover and a periphery of the platen; and a cloth accommodating space formed between the platen and the base to accommodate a surplus portion of the cloth.

11. The printer according to claim 10, further comprising:

a side wall to surround the cloth accommodating space, wherein the side wall is at least partially integral with the outer peripheral cover.

12. The printer according to claim 10, further comprising:

a side wall to surround the cloth accommodating space, wherein the side wall is at least partially integral with the base.

13. The printer according to claim 10, further comprising:

a side wall to surround the cloth accommodating space, wherein the side wall is displaceable between a first position to surround the cloth accommodating space and a second position to open the cloth accommodating space.

14. The printer according to claim 10, wherein the platen protrudes a prescribed length beyond the outer peripheral cover when a distance between the platen and the base is at shortest.

15. The printer according to claim 9, wherein the cloth holder includes:

a base;

a platen movably supported to and from the base to hold flat the portion of the cloth to be printed;

an outer peripheral cover to cover a periphery of the platen; and a height regulator to regulate a height of the outer peripheral cover from the base, wherein the cloth is sandwiched between the platen and the outer peripheral cover in the periphery of the platen, and wherein a height of the platen from the base is changeable in accordance with a thickness of the cloth mounted on the platen.

16. The printer according to claim 15, wherein the platen is movable at an angle to the base.

17. The printer according to claim 15, wherein the cloth holder includes a platen guide to guide the platen when the platen displaces.

18. A cloth holder to mechanically hold a cloth in a printing position in which an image is to be added by printing to a portion of the cloth held flat by the cloth holder, comprising:

a cassette base;

a pair of grooves each on an opposite side of the cassette base; and a platen to hold flat the portion of the cloth to be printed and that is detachably attached to the cassette base, wherein the cloth holder is configured to be inserted into a printer that prints the image and into a heater that heats the cloth by sliding along the pair of grooves.

19. The cloth holder according to claim 18, wherein the platen is configured to resist heat up to a prescribed temperature at which a heater heats the cloth, and wherein a face of the platen facing the cloth is made of heat insulating material.

20. A holder with a blank cloth comprising:

the cloth holder according to claim 18; and a blank cloth held by the cloth holder, wherein at least the portion of the blank cloth is held flat by the cloth holder.

* * * * *